US008374538B2

(12) United States Patent
Kougami et al.

(10) Patent No.: US 8,374,538 B2
(45) Date of Patent: Feb. 12, 2013

(54) SHEET HUMIDIFIER, SHEET FINISHER, AND IMAGE FORMING SYSTEM

(75) Inventors: Masashi Kougami, Saitama (JP); Toshio Shida, Higashiyamato (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 211 days.

(21) Appl. No.: 12/835,466

(22) Filed: Jul. 13, 2010

(65) Prior Publication Data

US 2011/0020042 A1 Jan. 27, 2011

(30) Foreign Application Priority Data

Jul. 24, 2009 (JP) ..... 2009-172884

(51) Int. Cl.
*G03G 15/00* (2006.01)

(52) U.S. Cl. ..... 399/390; 399/406; 399/407; 430/97

(58) Field of Classification Search ..... 399/341, 399/390, 406
See application file for complete search history.

(56) References Cited

U.S. PATENT DOCUMENTS

| | | | | |
|---|---|---|---|---|
| 3,647,525 | A * | 3/1972 | Dahlgren | 427/428.15 |
| 5,832,359 | A | 11/1998 | Acquaviva | |
| 5,895,154 | A | 4/1999 | Acquaviva et al. | |
| 6,935,995 | B2 * | 8/2005 | Siebert et al. | 492/56 |
| 8,170,459 | B2 * | 5/2012 | Shida | 399/341 |
| 8,265,541 | B2 * | 9/2012 | Kougami | 399/406 |
| 2006/0133876 | A1 * | 6/2006 | Kougami et al. | 399/407 |
| 2006/0185541 | A1 * | 8/2006 | Czeranka et al. | 101/376 |
| 2007/0048048 | A1 * | 3/2007 | Kougami et al. | 399/341 |
| 2009/0229515 | A1 * | 9/2009 | Kougami | 118/695 |
| 2009/0245908 | A1 * | 10/2009 | Shida | 399/407 |
| 2010/0284717 | A1 * | 11/2010 | Shida | 399/341 |

FOREIGN PATENT DOCUMENTS

| | | | |
|---|---|---|---|
| JP | 2006-8282 | A | 1/2006 |
| JP | 2007058026 | A * | 3/2007 |
| JP | 2007276985 | A * | 10/2007 |

OTHER PUBLICATIONS

English machine translation of Shida et al. (JP 2007-276985 A).*
English machine translation of Konoue et al. (JP 2007-085026 A).*

* cited by examiner

*Primary Examiner* — David Gray
*Assistant Examiner* — Geoffrey Evans
(74) *Attorney, Agent, or Firm* — Holtz, Holtz, Goodman & Chick, PC

(57) ABSTRACT

A sheet humidifier which executes a humidifying process to a sheet, the sheet humidifier including: a pair of humidifying rollers each of which has a first surface layer formed of rubber containing plasticizer, the pair of humidifying rollers nipping and conveying the sheet; and two water supply rollers each of which has a second surface layer formed of rubber containing the same kind of plasticizer as the plasticizer of the first surface layer, the two water supply rollers contacting each of the pair of humidifying rollers and supplying water to the each of the pair of humidifying rollers, wherein a hardness of the first surface layer is higher than the second surface layer.

5 Claims, 4 Drawing Sheets

SHEET HUMIDIFIER, SHEET FINISHER, AND IMAGE FORMING SYSTEM

CROSS REFERENCE TO RELATED APPLICATION

The present application is based on Japanese Patent Application No. 2009-172884 filed with Japanese Patent Office on Jul. 24, 2009, the entire content of which is hereby incorporated by reference.

FIELD OF THE INVENTION

The present invention relates to a sheet humidifier, a sheet finisher provided with this sheet humidifier, and an image forming system provided with this sheet humidifier.

BACKGROUND OF THE INVENTION

In an image forming apparatus using an electrophotographic process, a toner image is fixed onto a sheet by heating. However, moisture evaporates from the sheet having been heated in the process of fixing. This causes an uneven distribution in the percentage of water content in the sheet, with the result that sheet bending known under the name of "lenticulation" occurs.

To avoid such lenticulation, a sheet humidifying technology has been developed to supply water to the sheet with an image formed thereon. In such a sheet humidifying process, when a sheet is to be humidified, the entire surface of the sheet must be uniformly humidified. Uniform humidifying processes are proposed in the Unexamined Japanese Patent Application Publication No. 2006-8282 and U.S. Pat. Nos. 5,832,359 and 5,895,154.

In the Unexamined Japanese Patent Application Publication No. 2006-8282, water is supplied to the surface of a humidifying roller so that sheets are humidified, when sheets are held and conveyed by a pair of humidifying rollers. A regulating device for regulating the amount of supplied water is built into a water-supplying device for supplying the humidifying roller with water.

In the proposal made in the U.S. Pat. No. 5,832,359, when sheets are held and conveyed by a pair of humidifying rollers, water is supplied to the surface of a humidifying roller so that the sheets are humidified. The water layer on the surface of the roller for supply water to the humidifying roller is optically detected. Based on the result of detection, water supply is controlled, whereby uniform humidifying is achieved.

The U.S. Pat. No. 5,895,154 proposes a sheet humidifier wherein sheets are humidified by water supplied to the surface of a humidifying roller when the sheets are held and conveyed by a pair of humidifying rollers, and wherein the surface of the humidifying roller is made of fiber.

When a sheet humidifier has been used for a long time, the problem is a failure in ensuring uniform humidifying because of the deteriorated surface of the humidifying roller. The Unexamined Japanese Patent Application Publication No. 2006-8282, U.S. Pat. Nos. 5,832,359 and 5,895,154 disclose inventions of uniformly humidifying all the sheet surfaces. However, the Unexamined Japanese Patent Application Publication No. 2006-8282, U.S. Pat. Nos. 5,832,359 and 5,895,154 fail to consider the problem of uniform humidification being disabled by long-term operations.

SUMMARY OF THE INVENTION BRIEF DESCRIPTION OF THE DRAWINGS

One aspect of the present invention is a sheet humidifier which executes a humidifying process to a sheet, the sheet humidifier comprising: a pair of humidifying rollers having a first surface layer formed of rubber containing plasticizer and nipping and conveying the sheet; and two water supply rollers each of which includes a second surface layer formed of rubber containing the same kind of plasticizer as the plasticizer of the first surface layer, contacting each of the pair of humidifying rollers and supplying water to the each of the pair of humidifying rollers, wherein a hardness of the first surface layer is higher than the second surface layer.

DETAILED DESCRIPTION OF THE PREFERRED EMBODIMENT

The following describes the present invention with reference to embodiments, however the scope of the present invention is not limited to the embodiments.

[Image Forming System]

Figure 1:
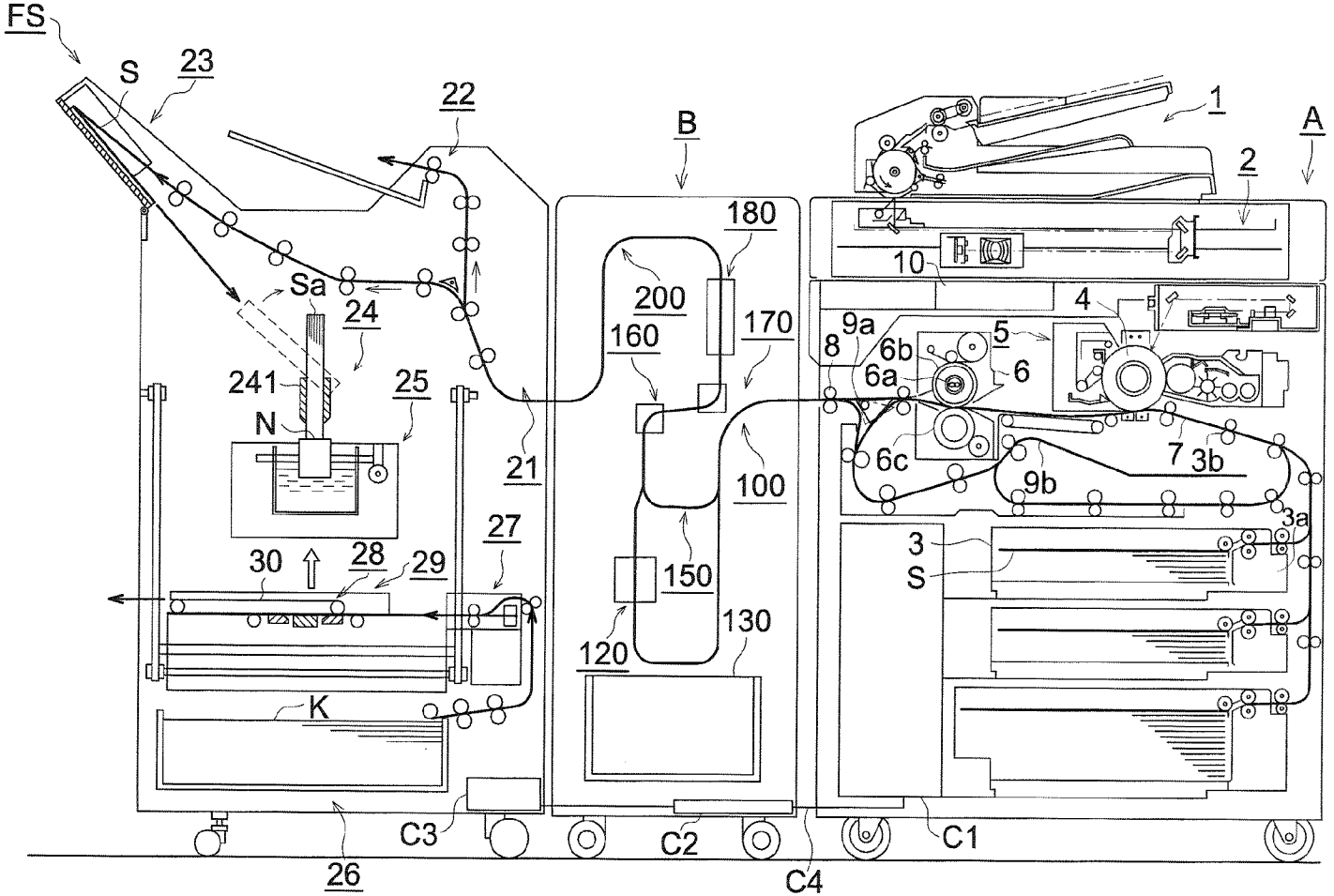
FIG. 1 is a general view representing an image forming system as an embodiment of the present invention.

FIG. 1 is a general view representing an image forming system as an embodiment of the present invention. This image forming system includes an image forming apparatus A, and sheet finishers B and FS.

The image forming apparatus A has an automatic document conveying apparatus 1 and an image reading section 2 on the top portion, and a printer section on the bottom portion.

In the printer section, reference numeral 3 denotes a sheet storage section for storing sheets S. In a printer engine 5 for forming a toner image on the photoreceptor 4 by the electrophotographic process that provides charging, exposure and development to the photoreceptor 4, an image is formed on the sheet S, and the formed image is fixed by the fixing section 6. In the fixing section 6, a nip section for conveying the sheet S is formed by a heating roller 6*b* incorporating a heat source 6*a* and a pressure roller 6*c*. The sheet S is conveyed, heated, and pressed at the same time so that toner is molten and the image is fixed onto the sheet S.

The sheet S is fed from the sheet storage section 3 to the first sheet feed device 3*a*, and is stopped once at the second sheet feed device 3*b*. After that, the sheet is fed and an image is formed. The sheet S with an image formed thereon is ejected from the sheet ejection section by the ejection roller 8.

The conveyance paths of the sheet S include a sheet feed path 7 leading from the sheet storage section 3 to the printer engine 5; a sheet conveyance path 9*a* leading from the printer engine 5 to the sheet ejection section through the fixing section 6 and ejection roller 8; and a sheet reverse-side conveyance path 9*b* used for reverse conveyance.

The image forming modes include a single-side face-down ejection mode, a single-side face-up ejection mode, and double-side mode. In the single-side face-down ejection mode, an image is formed on one side, and the sheet S having passed through the fixing section 6 is reversed by the reversing process. After that, this sheet S is conveyed by the ejection roller 8 and is ejected.

In the single-side face-up ejection mode, an image is formed on one side, and the sheet S is conveyed along the sheet conveyance path 9*a*. The sheet S is then conveyed and ejected directly by the ejection roller 8.

In the double-side mode, an image is formed on one side, and the sheet S is conveyed through the fixing section 6. This sheet S travels downward to reach the sheet reverse-side conveyance path 9*b*, wherein the sheet S is reversed, and is fed again to the sheet feed path 7.

In a printer engine 5, a reverse-side image is formed on the reverse side of the sheet S having been fed again. The sheet S with the reverse-side image formed thereon passes through the fixing section 6, and is conveyed and ejected by the ejection roller 8.

The reference numeral 10 indicates a control section to control the image formation in the image forming apparatus A and the operations of the image forming system as a whole. The operation section 10 is used to set various modes in the image forming apparatus A and the output mode using the sheet finisher FS.

The control section C1 arranged on the image forming apparatus A is connected to the control section C2 of the sheet finisher B and the control section C3 of the sheet finisher FS through the communication device C4.

The control section C1 controls the image forming process in the image forming apparatus A and the operations of the image forming system as a whole. The control section C2 controls the sheet finisher B, while the control section C3 controls the sheet finisher FS. The control sections C2 and C3 operate and control various operations in conformity to the instructions and information from the control section C1. Further, the control sections C2 and C3 report the states of sheet finishers B and FS to the control section C1. The control section made up of the control section C1, control section C2, and control section C3 control the image forming system as a whole.

The sheet S ejected from the image forming apparatus A is conveyed to the sheet finisher FS through the sheet finisher B.

The sheet finisher B includes the first loading and conveying section 100 for receiving and conveying the sheet S ejected from the image forming apparatus A, the sheet humidifier 120 for supplying water to the sheet S, the second loading and conveying section 150 for receiving and conveying the sheet S ejected from the image forming apparatus A, the first decurl section 160, the second decurl section 170, the third decurl section 180, and the sheet ejection conveyance section 200 for ejecting the sheet S and feeding the same to the sheet finisher FS.

The sheet finisher FS applies various forms of finishing processes to the sheet S ejected from the image forming apparatus A. The example shown in the figure is a glue book binding machine. A perforating and folding device, side stitching device, saddle sticking device, and cutting machine can be provided.

The glue book binding machine includes a sheet introducing device 21, ejecting device 22, sheet bundle storage device 23, sheet bundle conveying device 24, glue device 25, cover sheet supply device 26, cover sheet cutting device 27, cover sheet fitting device (folded binding device) 28, and aligning device 29.

The sheets S introduced into the sheet introducing device 21 are placed on the sheet bundle storage device 23, and are sequentially conveyed obliquely in the downward direction. The sheets S are then sandwiched by the gripping device 241 of the sheet bundle conveying device 24. While holding the sheet bundle Sa, the gripping device 241 turns over the sheet bundle Sa so that the surface (spine) of the sheet bundle Sa to be glued will face down, and stops at a predetermined position. The glue device 25 applies glue to the spine of the sheet bundle Sa.

The cover sheets K stored in the cover sheet supply device 26 are conveyed to the cover sheet fitting device 28 through the cover sheet cuffing device 27. After that, the trailing edges of the cover sheets K are trimmed to a predetermined length by the cover sheet cutting device 27. The trimmed length of the cover sheet K can be calculated by adding the length of two sheets S in the traveling direction to the thickness of the spine of the sheet bundle Sa.

The cover sheet fitting device 28 receives and conveys the cover sheet K supplied from the cover sheet supply device 26, and stops these cover sheets K at a predetermined position. After that, the cover sheet K is positioned across the width by the aligning device 29. The cover sheets K are pressed against the glued surface N of the sheet bundle Sa and are bonded thereto by the cover sheet fitting device 28

The cover sheet K is bent along the edge of the glued surface N of the sheet bundle Sa by downward traveling of the pressure member opposed to the spindle of the sheet bundle Sa and movement of a pair of holding members of bilateral symmetry arranged on the top of the cover sheet fitting device 28. This process produces a sheet bundle Sa with the cover sheet K bound on the obverse and reverse sides thereof.

Upon completion of the bending process of the cover sheet K, the cover sheet fitting device 28 lowers and retracts. After that, with the retraction of the aligning device 29, the ejection belt 30 having retracted to the outside across the width of the cover sheet K moves to the inside across the width below the sheet bundle Sa until the ejection belt 30 stops. After that, when the gripping force of the gripping device 241 has been released, the sheet bundle Sa lowers and the spine located below the sheet bundle Sa stops at the position in contact with the top surface of the ejection belt 30. The rotating ejection belt 30 bonds the cover sheet K onto the sheet bundle Sa, and a fold-bound booklet is ejected out of the apparatus.

[Sheet Finisher B]

Figure 2:
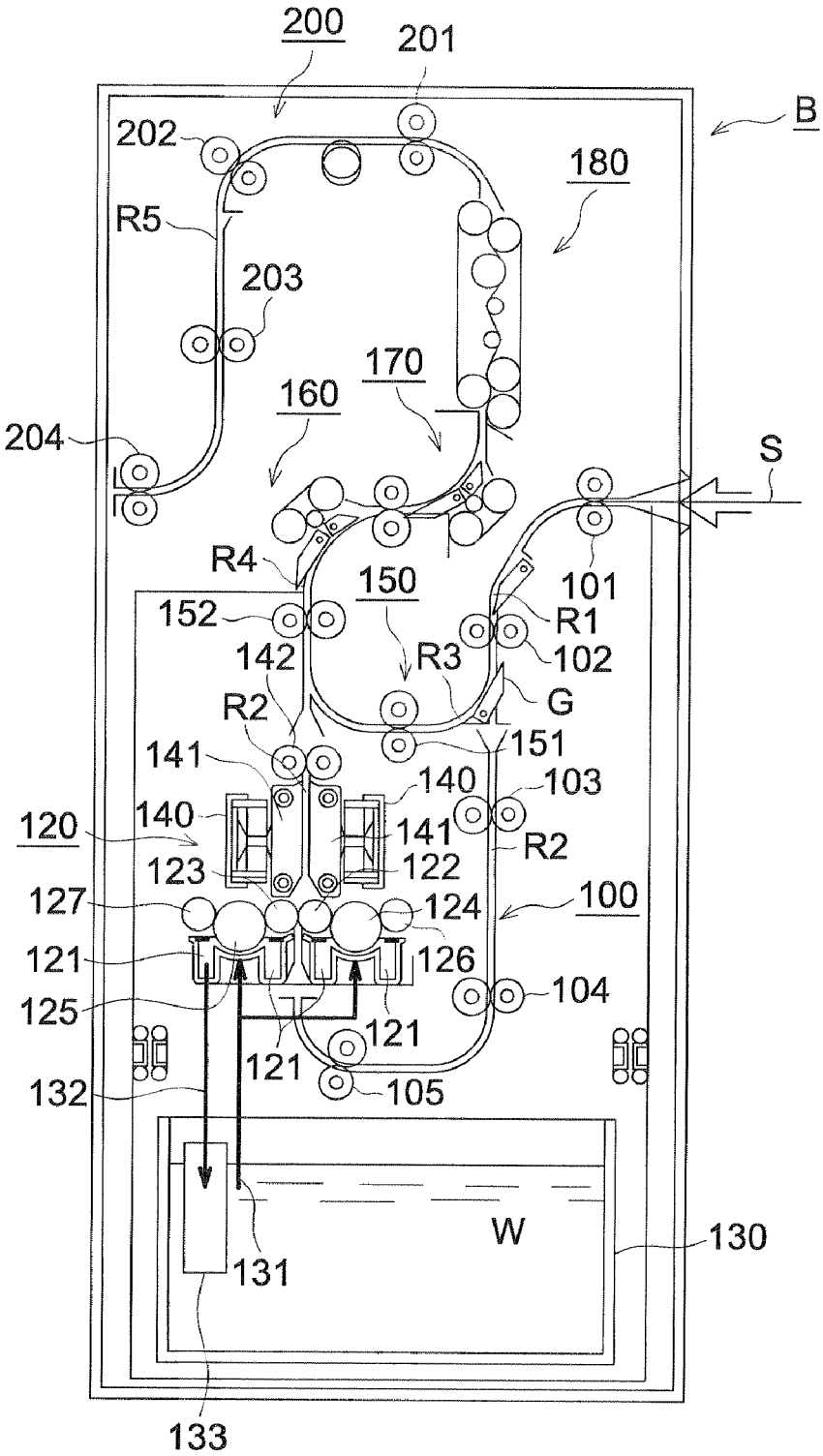
FIG. 2 is a general view representing a sheet finisher as an embodiment of the present invention.

FIG. 2 is a general view representing a sheet finisher as an embodiment of the present invention.

The first loading and conveying section 100 includes a sheet conveyance path R1, and the sheet humidifier 120 has a sheet conveyance path R2. The second loading and conveying section 150 contains a sheet conveyance path R3, and the first through third decurl sections 160, 170 and 180 have sheet conveyance paths R4. The sheet ejection conveyance section 200 incorporates a sheet conveyance path R5.

As illustrated, the sheet conveyance paths R1 through R5 are composed of a plurality of guide members.

A part of the sheet conveyance path R1 is shared by the first loading and conveying section 100 and second loading and conveying section 150.

The sheet S fed into the sheet finisher B is fed to the first decurl section 160 from the first loading and conveying section 100 through the second loading and conveying section 150 by the switching operation of the switching gate G. The sheet S is ejected through the second decurl section 170, third decurl section 180, and sheet ejection conveyance section 200, or is conveyed to the sheet humidifier 120 from the first loading and conveying section 100, and is ejected from the sheet humidifier 120 through the second loading and conveying section 150, first through third decurl sections 160, 170 and 180, and sheet ejection conveyance section 200.

In the first loading and conveying section 100, the sheet S is conveyed by the conveying rollers 101 through 105, and is then fed to the sheet humidifier 120.

In the sheet humidifier 120, the sheet S is conveyed by the humidifying rollers 122 and 123 and conveying roller 142.

In the second loading and conveying section 150, the sheet S is conveyed by the conveying rollers 101,102, 151, and 152.

In the sheet ejection conveyance section 200, the sheet S is conveyed by the conveying rollers 201 through 204, and is ejected.

The following describes various processing sections of the sheet finisher B.

<Sheet Humidifier>

Figure 3:
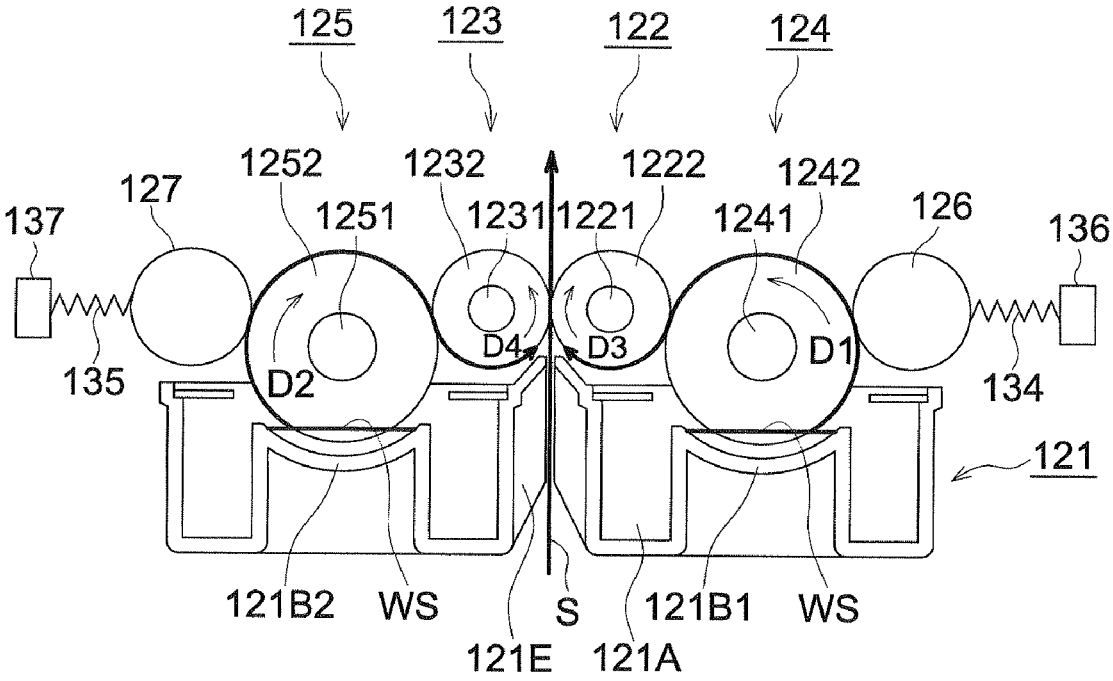
FIG. 3 is a diagram representing a configuration of a sheet humidifier.
Figure 4:
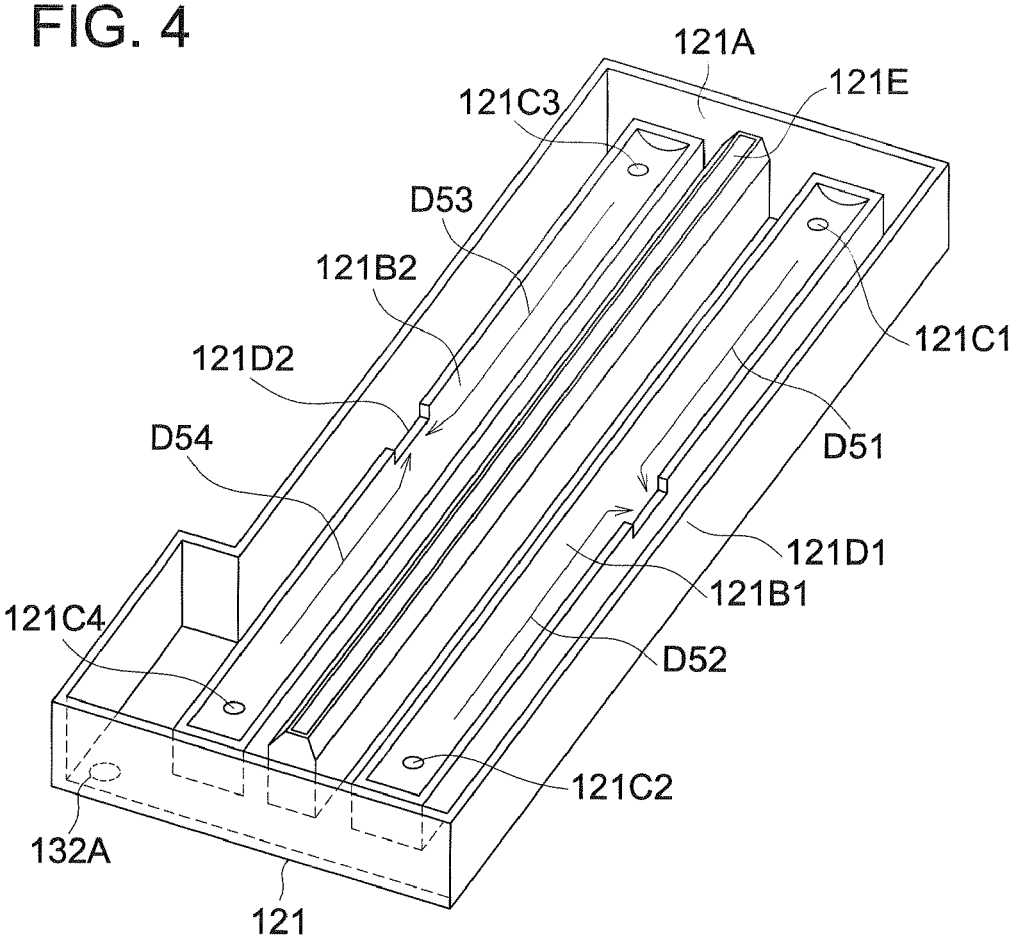
FIG. 4 is a view representing a cistern.

The following describes the structure and operation of the sheet humidifier 120 with reference to FIGS. 3 and 4. FIG. 3 is a front cross section representing a sheet humidifier, and FIG. 4 is a perspective view representing a sheet humidifier.

The cistern 121 for storing the water W for humidifying the sheet forms a water tank 121A that is slightly longer than the maximum width (length of the sheet in the direction perpendicular to the traveling direction) of the sheet S to be conveyed.

The cistern 121 is provided with water supply trays 121B1 and 121B2 arranged on the right and left.

The water supply trays 121B1 and 121B2 form the chambers for storing water at a position higher than the water tank 121A formed by the cistern 121.

Water stored in the water supply trays 121B1 and 121B2 overflows and drops into the water tank 121A.

The center of the cistern 121 is provided with a gap 121E through which the sheet S passes.

As shown in FIG. 4, the water supply trays 121B1 and 121B2 and the sheet passage forming the gap 121E are formed in an island structure within the water tank 121A.

The water supply trays 121B1 and 121B2 each have an arc-shaped inner peripheral surface corresponding to the cylindrical outer peripheral surface of the water supply rollers 124 and 125.

As will be described later, the water supply trays 121B1 and 121B2 are supplied with water W from water supply tube 131, and a predetermined level of water WS is maintained at all times by overflow from the discharge outlets 121D1 and 121D2.

Above the water supply trays 121B1 and 121B2, water supply rollers 124 and 125 are arranged at a predetermined distance away from the inner peripheral surface of the sheet feed tray 121B. The lower portions of the water supply rollers 124 and 125 are dipped in water stored in the water supply trays 121B1 and 121B2.

The water supply rollers 124 and 125 are the rubber rollers having the second surface layers 1242 and 1252 of rubber material formed on the metallic shafts 1241 and 1251. The water supply roller 124 rotates in the direction of arrow D1, and the water supply roller 125 rotates in the direction of arrow D2.

The humidifying roller 122 is provided so as to contact the water supply roller 124, and the humidifying roller 123 is arranged so as to contact the water supply roller 125. This arrangement allows the humidifying roller 122 and humidifying roller 123 to contact each other.

The humidifying rollers 122 and 123 are the rubber rollers respectively having first surface layers 1222 and 1232 of rubber material formed on the metallic shafts 1221 and 1231. The humidifying roller 122 rotates in the direction of arrow D3, and the humidifying roller 123 rotates in the direction of arrow D4. As illustrated, the sheet S is nipped and conveyed above.

Driven by a drive source (not illustrated), any one of the humidifying rollers 122 and 123 rotates as a drive roller. Other humidifying rollers and water supply rollers 124 and 125 are driven by the drive roller.

The reference numeral 126 denotes a regulating member in contact with the water supply roller 124, and 127 indicates a regulating member in contact with the water supply roller 125.

The regulating members 126 and 127 are metallic cylinders and are driven and rotated by the water supply rollers 124 and 125. The regulating members 126 and 127 are biased by the springs 134 and 135 so that the regulating member 126 will press the water supply roller 124, and the regulating member 127 will press the water supply roller 125. This structure allows the humidifying roller 122 and humidifying roller 123 to be pressed against each other by the elasticity of the rubber constituting these rollers and the elasticity of the springs 134 and 135 biasing the regulating members 126 and 127. This arrangement forms a nip and the passing sheet S is nipped and conveyed. At the same time, the sheet S is supplied with water Wand is humidified thereby.

The reference numeral 130 is a water storage tank, 131 is a water supply tube, 132 is a water discharge tube, and 133 is a filter.

Water W is supplied to the water supply trays 121B1 and 121B2 of the cistern 121 by the pump (not illustrated) from the water storage tank 130 through the water supply tube 131, and is returned to the water storage tank 130 from the cistern 121 through the water discharge tube 132.

Reference numerals 121C1 through 121C4 denote water supply ports. Water W supplied from the water supply port 121C1 through 121C4 through the water supply tube 131 flows as shown by arrows D51 through D54, and flows out of the discharge outlets 121D1 and 121D2.

The foreign substances such as paper dust having entered the water Win the process of supplying water W to the sheet are filtered out by the filter 133, and the water W circulates between the water storage tank 130 and cistern 121.

The sheet S is supplied with water in the following procedure.

The sheet S is conveyed into the sheet humidifier 120 by the conveying roller 105. After passing through the gap 121E, the sheet S is conveyed by the humidifying rollers 122 and 123.

A layer of water W is formed on the outer peripheral surface of the humidifying rollers 122 and 123, and the sheet S is supplied with water W on a continuous basis in the process of conveyance.

A layer of water W is formed on the outer peripheral surface of the water supply rollers 124 and 125, and is made uniform by the regulating members 126 and 127.

In the process of the sheet being supplied with water W, foreign substances such as paper dust of the sheet S may be attached to the humidifying rollers 122 and 123, and may further be mixed into the water W. The foreign substances mixed into the water W are filtered out by the filter 133.

The following describes the problems with the long-term operation of the sheet humidifier 120 and the solutions to these problems.

As described above, the humidifying rollers 122 and 123 are the rubber rollers having the first surface layers 1222 and 1232 of rubber material formed on the metallic shafts 1221 and 1231.

The rubber rollers are preferred for their capability of uniform humidification of the entire surface of the sheet.

When hard rollers having a hydrophilic surface such as metallic rollers are used as humidifying rollers, the sheet is nipped by a line, with the result that humidifying rollers may not touch the sheet. This may cause a failure in uniform humidification.

The rubber rollers having the second surface layers 1242 and 1252 formed on the metallic shafts 1241 and 1251 are used as the water supply rollers 124 and 125 for supplying water to the humidifying rollers 122 and 123.

The rubber rollers as humidifying rollers 122 and 123 have their diameters reduced by long-term use. Study of the mechanism of reduction in the diameter has revealed that diameter reduction is mainly caused by the removal of the plasticizers contained in the rubber.

Incidentally, a greater amount of plasticizer is contained in the softer rubber, i.e., rubber of lower hardness. Thus, the rubber roller made of the rubber of lower hardness is characterized by a faster reduction in the diameter.

For example, a regular-sized sheet such as A4-sized paper is fed through the sheet humidifier 120. Due to the long-term feeding of sheets, the rubber constituting the first surface layers 1222 and 1232 of the humidifying rollers 122 and 123 is worn by friction with friction with the sheets, and is subjected to degeneration and deformation caused by removal of the plasticizer. This results in a reduced diameter of the roll. Particularly in the sheet feed area wherein sheets are fed, there is a remarkable reduction in diameter. This produces a level difference between the sheet feed area and the non-sheet feed area located outside. As described above, the rubber of lower hardness contains a greater amount of plasticizer. Thus, in the humidifying roller made of the less hard rubber, a big level difference is observed between the sheet feed area and non-sheet feed area.

Figure 5:
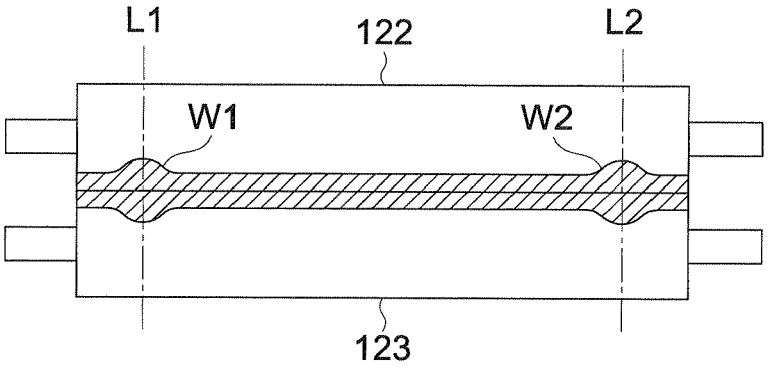
FIG. 5 is a diagram showing the humidifying rollers 122 and 123 during humidification as viewed from the bottom of FIG. 3.

Referring to FIG. 5, the following describes the impact of the level difference formed between the sheet feed area and non-sheet feed area upon the sheet humidifying performance. FIG. 5 is a diagram showing the humidifying rollers 122 and 123 during humidification as viewed from the bottom of FIG. 3.

A water accumulated portion indicated by oblique lines is formed around the nip wherein the humidifying roller 122 and humidifying roller 123 are brought in contact with each other. When there is a reduction in the diameters of the humidifying rollers 122 and 123 due to long-term operation, the amount of accumulated water is increased in the area centering on the boundary lines L1 and L2 between the sheet feed area and non-sheet feed area, over the amount of water in other areas, as indicated by W1 and W2.

Thus, a greater amount of water will be applied to the edge of the sheet, and the edge of the sheet will be more humidified. This will cause a failure such as formation of a wavy pattern on the sheet in some cases.

This makes it essential to eliminate the possibility of a level difference being created on the ends of the humidifying rollers 122 and 123.

In the meantime, when attention is paid to the relationship between the humidifying roller 122 and water supply roller 124, and the relationship between the humidifying roller 123 and water supply roller 125, the following can be seen. Namely, to form a uniform water layer on the surfaces of the humidifying rollers 122 and 123, the width of the nip formed by the humidifying roller 122 and water supply roller 124, and the width of the nip formed by the humidifying roller 123 and water supply roller 125 must be equal to or greater than a prescribed value.

These nip widths can be ensured by the hardness of the rubbers in contact, and the force of pressing the rubber roller. When a normal spring is used, the hardness of the rubber determines the nip width. To be more specific, the hardness of the rubbers constituting the humidifying rollers 122 and 123, and the hardness of the rubbers constituting the water supply rollers 124 and 125 determine the nip width. Thus, to form a uniform water layer on the humidifying rollers 122 and 123, a less hard material must be used to produce at least one of the rubber constituting the first surface layers 1222 and 1232 of the humidifying rollers 122 and 123, and the rubber constituting the second surface layers 1242 and 1252 of the water supply rollers 124 and 125.

To meet the above-mentioned conditions, namely, the condition of preventing a level difference from being formed on the ends of the humidifying rollers 122 and 123, and the condition of a lower level of hardness being used in at least one of the rubber constituting the humidifying milers 122 and 123, and the rubber constituting the water supply rollers 124 and 125, the hardness of the rubber constituting the first surface layers 1222 and 1232 of the humidifying rollers 122 and 123 is higher than the hardness of the rubber constituting the second surface layers 1242 and 1252 of the water supply rollers 124 and 125 in the present invention.

This arrangement ensures the above-mentioned two conditions to be met. Thus, a uniform layer of water is formed on the surfaces of the humidifying rollers 122 and 123, and avoids the formation of a level difference on the ends of the humidifying rollers 122 and 123 that may affect the humidifying performances, despite long-term operations. These characteristics have been successfully achieved by the present invention.

Further, it has also been known that, when the rubber roller made of a rubber characterized by a smaller content of plasticizer and a higher degree of hardness and the rubber roller characterized by a higher content of plasticizer and a lower degree of hardness are brought in contact with each other and are rotated for a long time, the plasticizer in the rubber transfers from the lower-hardness rubber into the higher-hardness rubber. When the plasticizer transfers between two rollers as described above, the rubber on the transferred side will be degenerated if there is a difference in the amount of the plasticizer contained in one of the rollers and that contained in the other. To prevent this, the same type of plasticizer is preferably contained in both of these rubber rollers.

To put it another way, the plasticizer contained in the first surface layers 1222 and 1232 of the humidifying rollers 122 and 123, and that contained in the second surface layers 1242 and 1252 of the water supply rollers 124 and 125 are preferably of the same type.

Pressurized contact between the humidifying roller 122 and humidifying roller 123, between the humidifying roller 122 and water supply roller 124, and between the humidifying roller 123 and water supply roller 125 can be eliminated by removing the pressure of the springs 134 and 135 applied to the regulating members 126 and 127. Removal of pressurized contact prevents deformation of the rubber roller and degeneration of the rubber.

Based on the information from the control section C1, the control section C2 moves the supporting members 136 and 137 supporting the springs 134 and 135 in the process of humidification, so that the sheet humidifier 120 is set to the state illustrated in FIG. 3. To be more specific, the control section C2 causes pressurized contact between a pair of humidifying rollers 122 and 123, between the humidifying roller 122 and water supply roller 124, and between the humidifying roller 123 and water supply roller 125. Further, if the distance between sheets exceeds a predetermined value, the control section C2, based on the information from the control section C1, moves the supporting members 136 and 137 to release pressurized contact between a pair of humidifying rollers 122 and 123, between the humidifying roller 122 and water supply roller 124, and between the humidifying roller 123 and water supply roller 125, when the sheet finisher B has stopped or when the sheet finisher B is in the idle state.

EXAMPLE

Using the sheet humidifier shown in FIG. 3 and the humidifying roller and water supply roller of Table 1, a sheet feeding test was conducted, wherein 1000 k (1000×1000) A4-sized sheets in portrait configuration (the short side placed in the traveling direction) were fed and humidified.

Humidifying roller: first surface layer: nitrile rubber (NBR)

Water supply roller: second surface layer: nitrile rubber (NBR)

TABLE 1

| | Hardness of humidifying roller rubber | Hardness of water supply roller | Humidifying roller rubber diameter (initial value) | Humidifying roller rubber diameter (after feeding 600 k sheets) | Wavy pattern of sheets |
|---|---|---|---|---|---|
| Example | 60 degrees | 25 degrees | 17.6 mm | 17.56 mm | Absent |
| Comparative example | 25 degrees | 25 degrees | 17.6 mm | 17.45 mm | Present |

As shown in Table 1, excellent humidification performances were observed in the Example without any wavy pattern of sheets. However, in the Comparative Example, a wavy pattern occurred when 600 k sheets had been fed. The rubber hardness of the humidifying roller and that of water supply roller of Table 1 are based on the measurements in conformity to JIS A. at a lower cost.

What is claimed is:

1. A sheet humidifier which executes a humidifying process on a sheet, the sheet humidifier comprising:

a pair of humidifying rollers each of which includes a first surface layer formed of rubber containing plasticizer, the pair of humidifying rollers nipping and conveying the sheet; and two water supply rollers each of which includes a second surface layer formed of rubber containing a same kind of plasticizer as the plasticizer of the first surface layer, wherein the two water supply rollers contact respective ones of the pair of humidifying rollers and supply water to the respective ones of the pair of humidifying rollers, and wherein an amount of the plasticizer contained in the first surface layer is smaller than an amount of the plasticizer contained in the second surface layer.

2. The sheet humidifier described in claim 1, further comprising a control section controlling a pressurized contact and a release of pressurized contact between the pair of humidifying rollers and controlling a pressurized contact and a release of pressurized contact between each of the pair of humidifying rollers and the respective ones of the pair of water supply rollers, wherein the control section releases the pressurized contact between the pair of humidifying rollers and releases the pressurized contact between each of the pair of humidifying rollers and the respective ones of the pair of water supply rollers, when a distance between sheets exceeds a predetermined value, or when the sheet humidifier has stopped or is in an idle state.

3. A sheet finisher comprising the sheet humidifier described in claim 1, the sheet finisher finishing the sheet on which the humidifying process has been executed.

4. An image forming system comprising:

an image forming apparatus which forms an image on a sheet; and the sheet humidifier described in claim 1, the sheet humidifier executing the humidifying process on the sheet on which the image has been formed by the image forming apparatus.

5. The image forming system described in claim 4, further comprising a sheet finisher which finishes the sheet on which the humidifying process has been executed by the sheet humidifier.

* * * * *